US005294178A

United States Patent [19]

Bögle et al.

[11] Patent Number: 5,294,178

[45] Date of Patent: Mar. 15, 1994

[54] TILT DEVICE FOR SEAT FURNITURE

[75] Inventors: Dagobert Bögle, Laufenburg; Manfred Schlegel, Küssaberg-Reckingen; Horst Ziegler, Albbruck, all of Fed. Rep. of Germany

[73] Assignee: Christof Stoll GmbH + CO KG, Waldshut-Tiengen, Fed. Rep. of Germany

[21] Appl. No.: 795,765

[22] Filed: Nov. 21, 1991

[30] Foreign Application Priority Data

Dec. 13, 1990 [DE] Fed. Rep. of Germany ..... 90124041

[51] Int. Cl.[5] ..... A47C 1/032

[52] U.S. Cl. ..... 297/301; 297/365; 297/302

[58] Field of Search ..... 297/301, 300, 302, 304, 297/363-365

[56] References Cited

U.S. PATENT DOCUMENTS 3,356,414 12/1967 Doerner ..... 297/301
4,125,288 11/1978 Hunter .
4,966,412 10/1990 Dauphin ..... 297/301
4,986,601 1/1991 Inoue ..... 297/301

FOREIGN PATENT DOCUMENTS 0126839 12/1984 European Pat. Off. .
0233974 9/1987 European Pat. Off. .
2119641 11/1983 United Kingdom ..... 297/301

*Primary Examiner*—Peter R. Brown
*Attorney, Agent, or Firm*—Oblon, Spivak, McClelland, Maier & Neustadt

[57] ABSTRACT

In a tilt device for seat furniture, the base, which is fastened to the chair bottom part and which carries a rotatable backrest carrier for the backrest and a seat plate for the seat, is designed as a closed carrier box composed of a plurality of sheet-metal parts and is arranged between backrest cheeks of the backrest carrier. A simple compact construction of the mechanism, which can be used without appreciable changes for a permanent-contact backrest and for a simultaneous mechanism, is obtained.

9 Claims, 5 Drawing Sheets

FIG. 4a
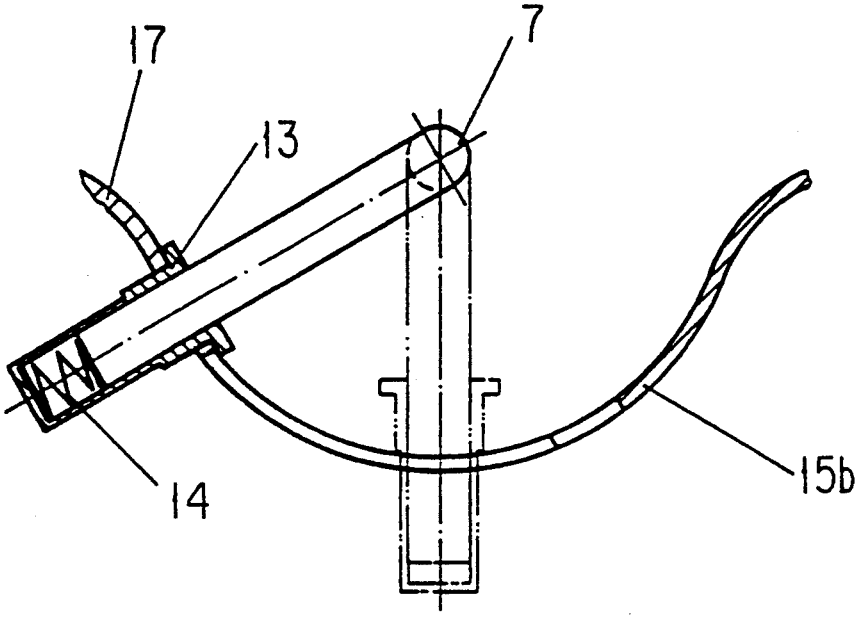
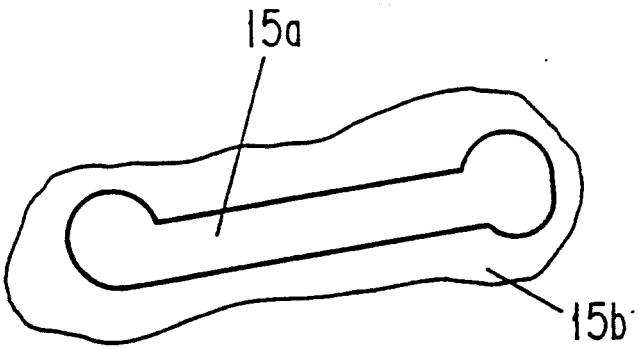
FIG. 4b

TILT DEVICE FOR SEAT FURNITURE

BACKGROUND OF THE INVENTION

1. Field of the Invention

The present invention relates to the field of seat furniture. It relates particularly to a tilt device for seat furniture, comprising (a) a base which can be fastened to an underframe of the seat furniture, preferably a chair column, and which serves as a carrier for a seat and a backrest;

(b) an angular backrest carrier with a lower leg and an upper leg, said backrest carrier being rotatably mounted on the base in the middle region of its lower leg by means of a rotary bearing and consisting, at least in its lower leg, of two backrest cheeks arranged parallel to and at a distance from one another;

(c) a seat plate which is supported at least in its front region by the base; and (d) at least one spring element which is fastened to the base on one side and which on the other side engages on the backrest carrier behind the rotary bearing and exerts an upwardly directed force on the backrest carrier.

Such a tilt device is known, for example, from EP-B1-0,233,974 of the same applicant.

2. Discussion of the Related Art

Two solutions conducive to dynamic sitting have found acceptance:

(1) As a basic version, chairs with a so-called "permanent-contact backrest", that is to say with a backrest mechanism which generates a specific countermoment, in order to compensate the variable leaning moment of the chair user by means of the tilting range of the backrest. The range of countermoments generated can at the same time, if appropriate, be adjusted to the individual weight of the user's upper body.

(2) As a sophisticated version, chairs or armchairs with a so-called "simultaneous" or "synchronous" mechanism. In this mechanism, the seat too—coupled with the permanent-contact backrest—varies its tilt in a specific ratio. Especially when the tilting ranges of the backrest are relatively wide, this simultaneous or synchronous change of the seat tilt is a necessary measure, in order, among other things, to counteract the forward displacement of the buttocks which occurs as a result of the leaning moment.

In the publication mentioned in the introduction, although a chair mechanism allowing the two above-explained possibilities of variation is described, nevertheless this known chair mechanism has essentially the following disadvantage:

The basic elements of the mechanism (housing, springing, locking, etc.) are designed for the complicated simultaneous mechanism. The constructional outlay and production costs are therefore considerable, because, in principle, a simultaneous mechanism has to be "scaled down", in order to obtain a simpler permanent-contact mechanism. At the same time, the relatively expensive housing made of cast metal or fiber-reinforced plastic, the complicated selectively usable locking for retained positions and other special designs of the mechanism are preserved.

SUMMARY OF THE INVENTION

The object of the present invention is to provide a chair mechanism in the form of a tilt device, which is distinguished by a simplified construction, can be produced cost-effectively in relatively large series and, starting from the simpler permanent-contact mechanism, can be extended by means of only a few additional parts to form a simultaneous mechanism.

The object is achieved, in a tilt device of the type mentioned in the introduction, in that (e) the base is designed as a narrow closed carrier box which is composed of a plurality of sheet-metal parts and which is arranged between the backrest cheeks; and (f) the carrier box has on its front side a sheet-metal crossmember which projects laterally beyond the extended backrest cheeks and which carries the seat plate in its front region.

The essence of the invention is to provide, as a receptacle for the chair column and as a carrier for the seat and backrest, a closed narrow carrier box which consists of few sheet-metal parts and is located between the backrest cheeks and which in the front part guarantees a support of the seat over a wide base by means of an additional crossmember.

Such a carrier box can be produced simply and cost-effectively, can, if required (for example, for the more complicated simultaneous mechanism), easily be supplemented by additional parts and as a result of the box design achieves a very high bending and torsional resistance, while at the same time ensuring that only a small amount of material is used.

According to a first preferred embodiment of the invention, the crossmember serves at the same time as a supporting and guiding bearing for the locking device of the permanent-contact or simultaneous mechanism, in that (a) there is a locking device, with a locking pin which can engage into a plurality of locking bores made at the front of the backrest carrier;

(b) the locking bores are made directly on the front end of one of the backrest cheeks; and (c) the crossmember possesses, on the side which projects beyond the backrest cheek equipped with the locking bores, two mutually spaced tabs which are perpendicular to the crossmember and in which the locking pin is guided.

A further preferred embodiment of the invention is defined in that (a) the sheet-metal parts of the carrier box and the crossmember are deep-drawn sheet-metal parts or bent parts;

(b) the carrier box comprises a box-shaped lower part and a cover; and (c) the cover, lower part and crossmember are connected to one another by means of a plurality of welding spots.

Sheet steel is preferred in all cases as a material for the sheet-metal parts.

Further embodiments emerge from the subclaims.

BRIEF DESCRIPTION OF THE DRAWING

The invention will be explained in more detail below by means of exemplary embodiments in conjunction with the drawing. In this:

FIG. 4*a* shows, in crosssection, a preferred exemplary embodiment of a slotted guide of the locking pin of FIG. 3;

FIG. 4*b* shows a preferred guide path from the slotted guide according to FIG. 4*a* in the form of a thread segment.

DESCRIPTION OF THE PREFERRED EMBODIMENTS

Figure 1:
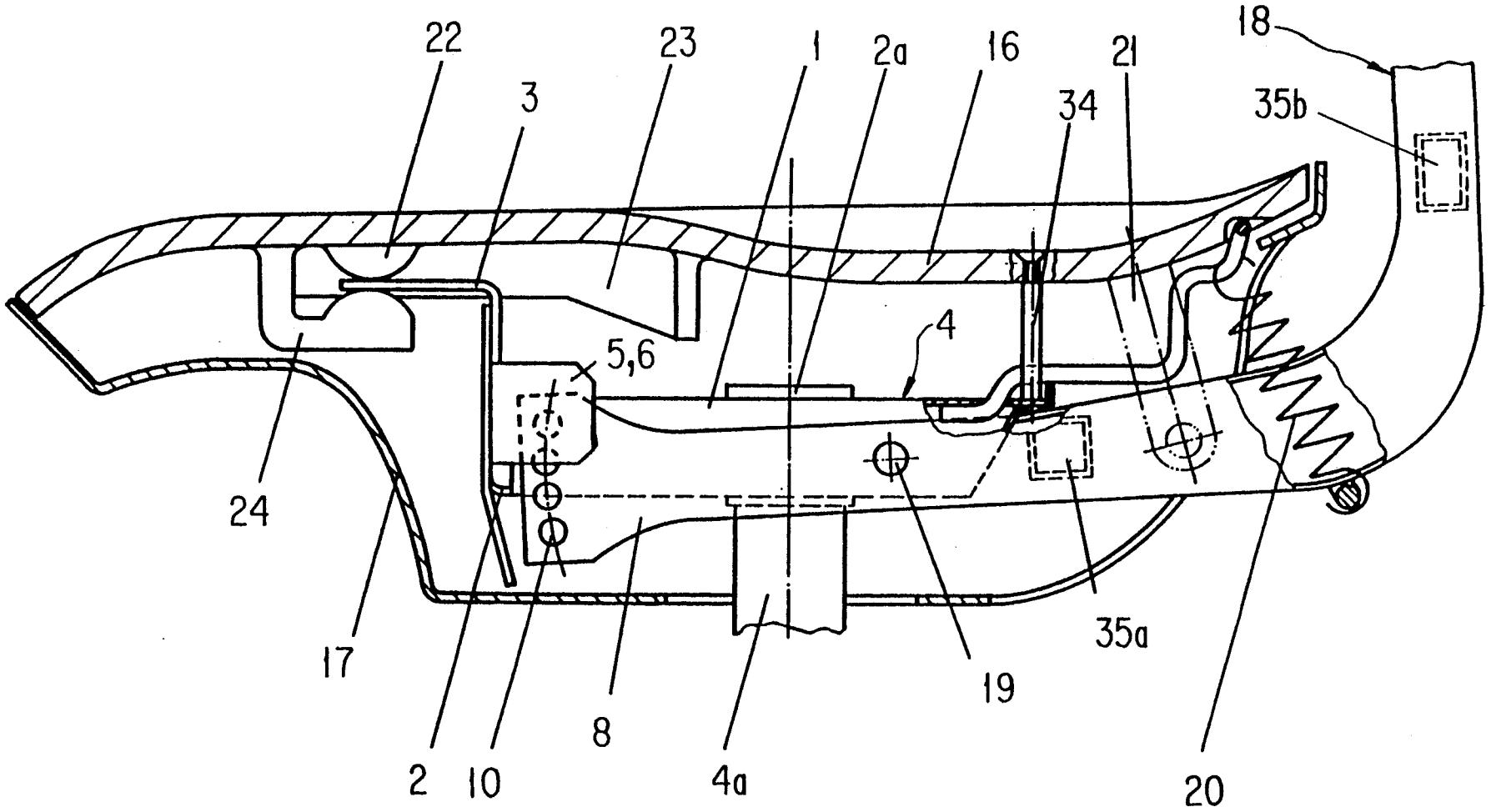
FIG. 1 shows, in crosssection, a first exemplary embodiment of a tilt device according to the invention in the form of a simplified permanent-contact mechanism with a fixed seat plate.

A first preferred exemplary embodiment of a chair mechanism according to the invention is reproduced in FIG. 1 in the form of the simpler permanent-contact mechanism.

Figure 5A:
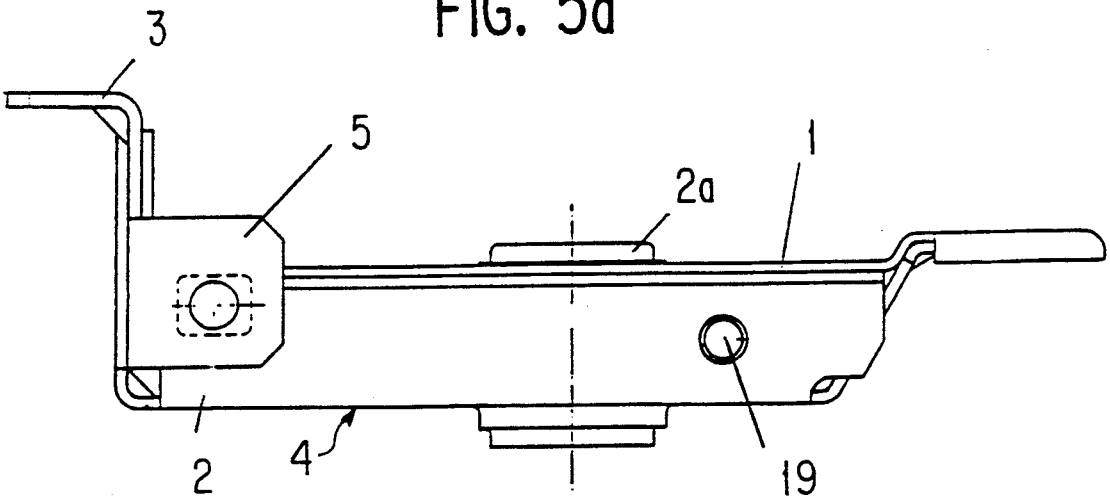
FIGS. 5*a* and 5*b* show the individual carrier box with crossmember according to FIGS. 1 to 3 in a side view (a) and top view (b).
Figure 5B:
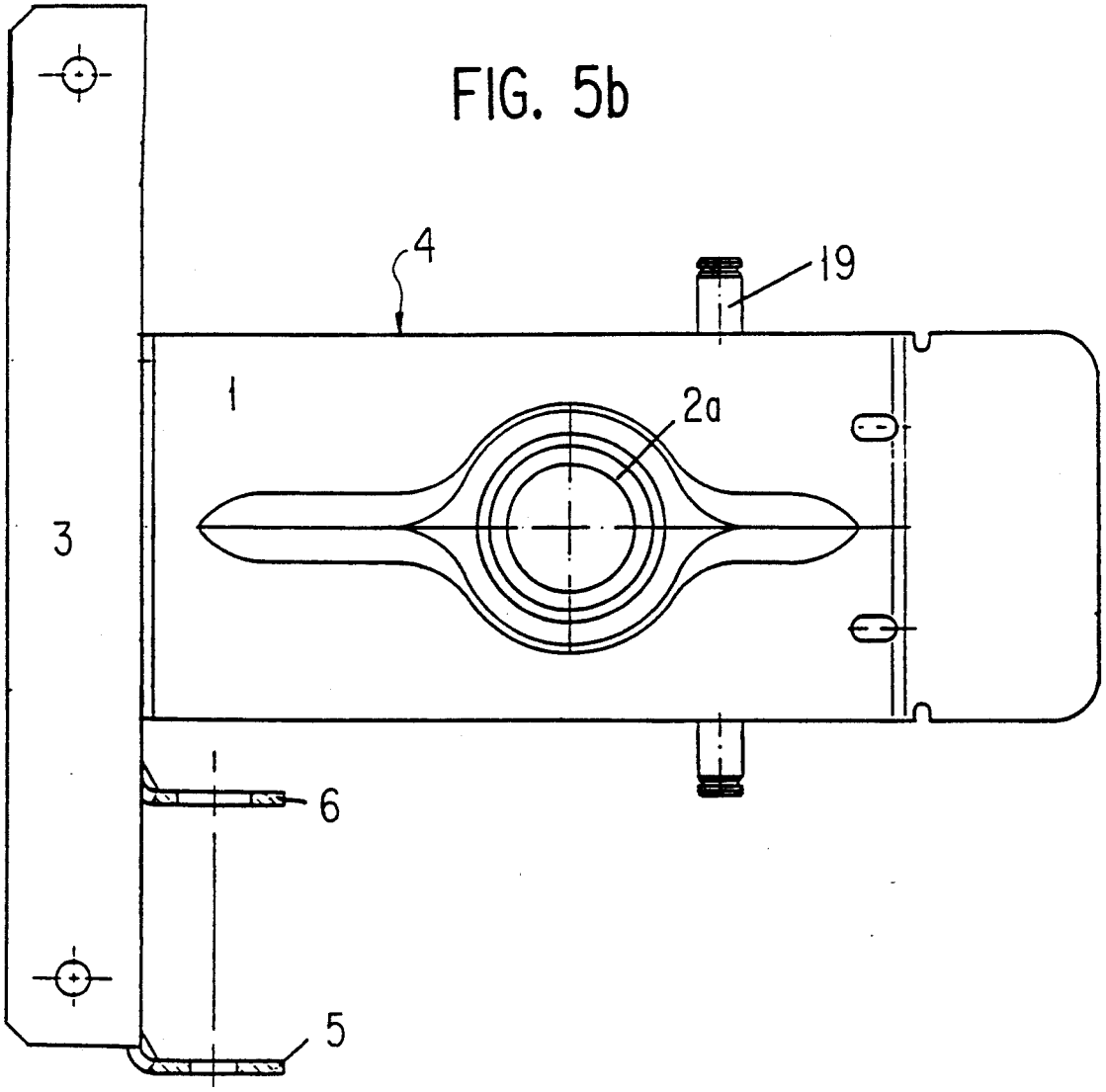

The main part of this tilt device is an only partially visible carrier box 4 which, as can be seen more clearly in FIGS. 5*a* and 5*b*, is composed of a box-shaped lower part 2, of a cover 1 arranged on this and of a crossmember 3 attached to the front side (in relation to the chair).

The lower part 2, cover 1 and crossmember 3 are preferably deep-drawn or bent parts of sheet steel which are connected integrally by spot welding to form the finished carrier box 4. At the same time, as shown in FIG. 5*a*, the crossmember 3 can be a special sheet-metal part which is welded to the lower part 2 and to the cover 1, or else it can be formed together with the lower part 2 from a sheet bar by appropriate bending.

The carrier box 4 receives the (usually rotatable) chair bottom part. This is carried out either in a way known per se by means of a conical plug connection or directly by welding a chair column of the chair bottom part (4*a* in FIG. 1) into the carrier box 4. Where the conical plug connection is concerned, there is in the carrier box 4 a receiving cone 2*a* which can be formed from the lower part 2 or, for example, is introduced nonpositively or positively as a separate part (especially an extruded part) into the carrier box 4.

Figure 3:
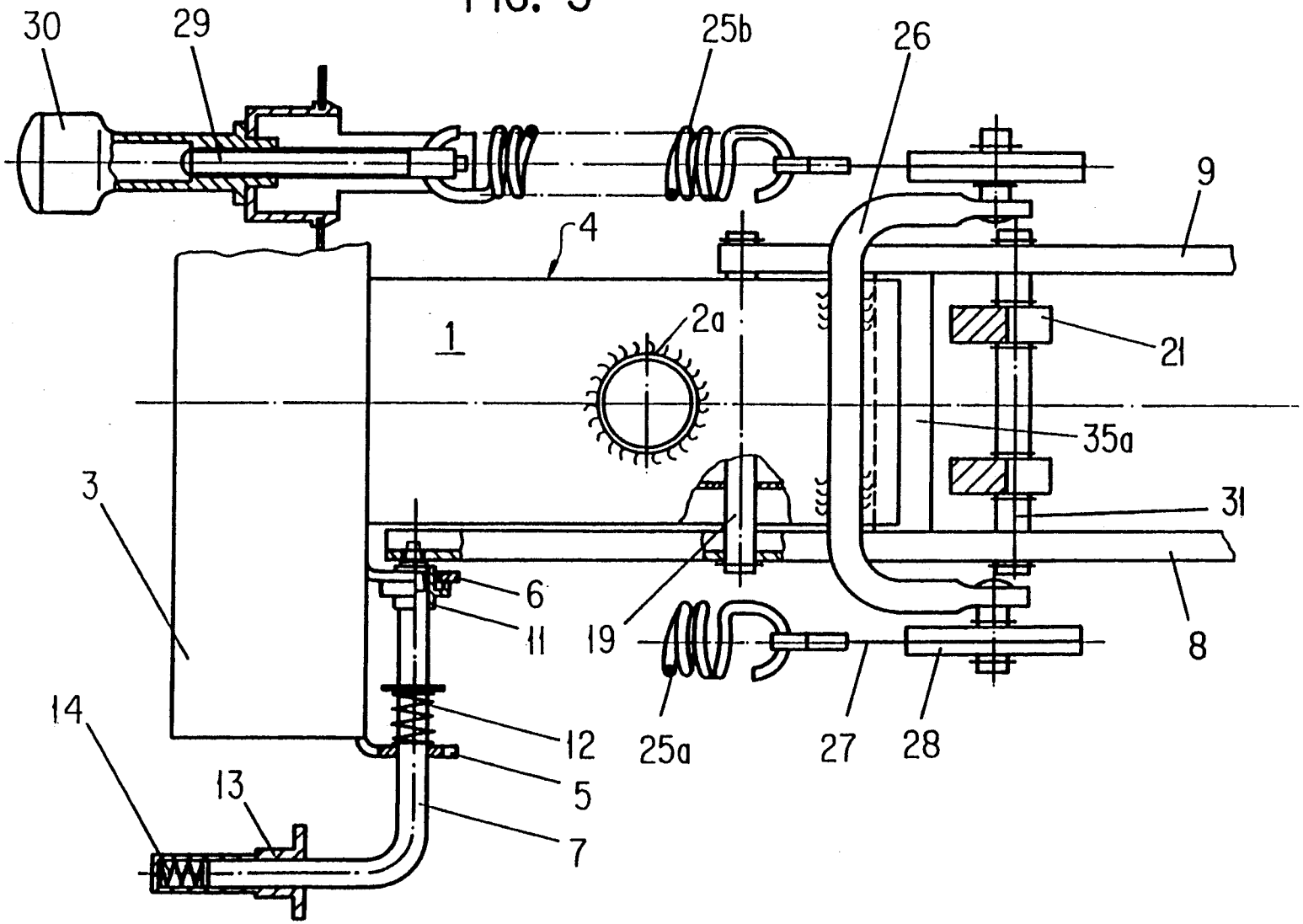
FIG. 3 shows a top view of the simultaneous mechanism according to FIG. 2*a* with details of the springing and locking.

Bent on one side of the crossmember 3 are two tabs 5 and 6 which have passage bores and which are part of a locking device explained in more detail later in conjunction with FIGS. 3, 4*a* and 4*b*.

A seat plate 16 and a backrest carrier 18 are at the same time fastened to the carrier box 4. The seat plate 16 is supported (displaceably in principle) on the crossmember 3 in the front region by means of supporting projections 22 and counter-projections 24 and itself carries a seat cushion (not shown in FIG. 1). It is firmly connected, if the permanent-contact mechanism is used, to the carrier box 4 in the rear region by means of a seat stay 34. The backrest carrier 18 is angular with an upper and a lower leg. It is mounted rotatably on the carrier box 4 in the middle region of its lower leg and on the upper leg carries a backrest (likewise not shown).

Furthermore, the backrest carrier 18 is of asymmetric design, that is to say it consists (at least in its lower leg) of two U-shaped backrest cheeks 8 and 9 (FIG. 3) of unequal length and arranged parallel to and at a distance from one another. The shorter backrest cheek 9 terminates directly behind the rotary bearing. The longer backrest cheek 8 is located on the side of the locking device and is so shaped at its front end that locking bores 10 can be made there.

The backrest carrier 18 is mounted rotatably on an axle shaft 19. The axle shaft 19 is itself connected to the carrier box 4, that is to say, for example, is pressed into corresponding bores. The two backrest cheeks 8 and 9 are connected to one another in a torsion-resistant manner behind the rear end of the carrier box 4, preferably by means of a welded-in (round or angular) tubular piece 35*a*. Further cross connections, such as, for example, the tubular piece 35*b*, are provided elsewhere, in order to form a limit stop for the vertical adjusting range of the backrest and at the same time make it possible to fasten cladding parts.

The necessary torsional resistance of the backrest carrier 18 loaded on one side is deliberately assisted by its narrow design, in that the torsional moment introduced is kept low. One or more permanent compensating springs 20, which are arranged between the rotatably mounted backrest carrier 18 and the rear end of the carrier box 4, compensate the leaning moment of the upper body when it leans against the permanent-contact backrest of FIG. 1.

As already mentioned previously and as can easily be seen in FIGS. 3 and 5*b*, the two tabs 5 and 6 are bent on one side of the crossmember 3 and have passage bores for guiding a locking pin 7. Since, as a result of constructional tolerances, the locking pin 7 is never aligned exactly with the associated locking bores 10 in the backrest cheek 8, the locking pin 7 is preferably guided in a tolerance-compensating bearing 11 mounted so as to be displaceable perpendicularly to the direction of movement of the pin (FIG. 3). The tolerance-compensating bearing 11, which consists, for example, of a resistant plastic, is snapped into an appropriately shaped orifice in the tab 6. A suitably shaped tip on the locking pin 7, in conjunction with the displaceable tolerance-compensating bearing 11, guarantees that the locking pin 7, even when off-center, is automatically positioned centrally in one of the locking bores 10.

A locking spring 12 constantly presses the locking pin 7 into one of the locking bores 10 under appropriate prestress. When the locking pin is pulled outwards, the lock is released. The backrest can then be used as a permanent-contact backrest. There is, at the same time, a plurality of possibilities for keeping the locking pin 7 in the two different positions. The locking device can be operated especially simply, cost-effectively and easily if the locking pin 7 is cranked at the end and if the cranked end is guided at a particular distance from the pin axis in a recess which has the form of a thread segment 15*a* (FIG. 4*b*). The locking pin 7 is displaced in the direction of the pin axis by the pitch of the thread segment 15*a* as soon as the cranked end runs rotationally up against the thread segment 15*a*.

Thus, when the cranked end of the locking pin 7 is appropriately moved by hand, the locking pin 7 is pulled out of the lock counter to the increasing force of the locking spring 12. It conversely locks automatically. The thread segment 15*a* acts as a reducing transmission. Appropriately shaped recesses at the ends of the thread segment 15*a* ensure that the locking pin, when released or locked, remains in position.

To prevent the lock from being released unintentionally, the thread segment 15*a* is preferably designed as a slotted guide 15*b* (FIG. 4*a*). A stepped sleeve 13 is pushed over the cranked end of the locking pin 7. The stepped sleeve 13 has an edge which, by means of an appropriately large diameter, in principle prevents the sleeve from being pressed out of the slot by an internal spring 14, specifically irrespective of the particular position in which the pin end is located at that movement.

The diameter of the step under the edge fits into the larger slot cutouts in the locking and release positions of the pin, but is too large for the actual guide slot. Only when the stepped sleeve 13 is pressed upwards counter to the force of the spring 14 can the pin end move through the slot. The specific movements—first pressing and then displacing—prevent the lock from being released unintentionally if, for example, the user knocks against the pin end.

Of course, the operating mode of this release safeguard can also be reversed, by the stepped sleeve 13 being pulled downwards counter to a tension spring which frees the slot.

With a view to a simple and cost-effective solution, the slotted guide **15*b* is preferably the formed-on version of a seat cover 17 (FIGS. 1 and 4*a*). The seat cover 17 is in this case firmly connected either to the seat or to the carrier box 4. In the exemplary embodiment of FIG. 1, the connection to the seat plate 16** has been chosen. In particular, a larger space is available there, and the technical preconditions for a simple snap or clip connection are better on both parts, especially when they are injection-molded from plastic.

Figure 2:
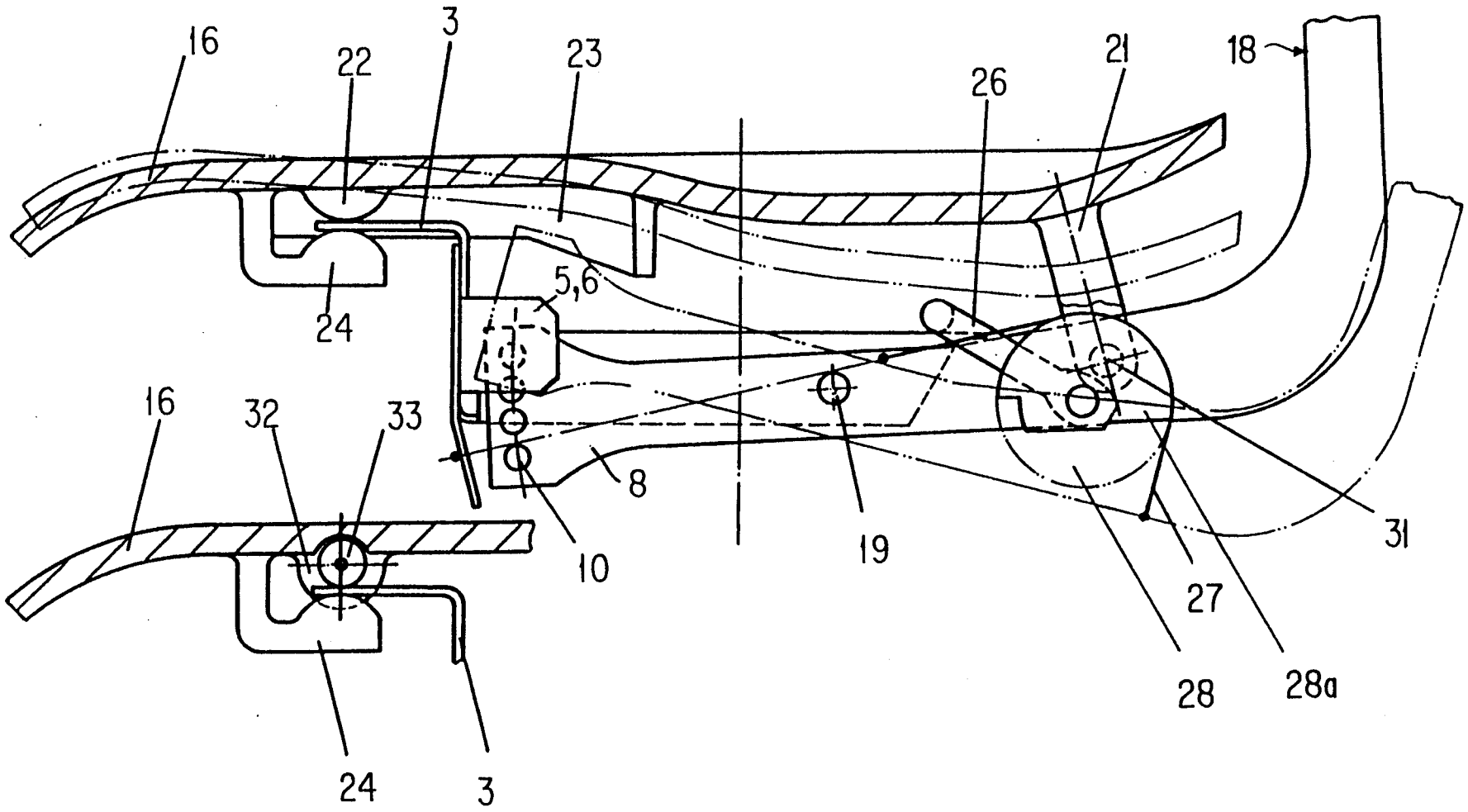
FIG. 2*a* shows a second exemplary embodiment, similar to that of FIG. 1, of a tilt device according to the invention in the form of a simultaneous mechanism with a variable tilt of the seat plate.
FIG. 2*b* shows in cutout form a front mounting, alternative to FIGS. 1 and 2*a*, of the seat plate on the crossmember.

For the version with the more complicated synchronous mechanism (FIGS. 2 and 3), it is necessary to have the following forms of construction which can partially be identical in terms of construction to parts of the above-described permanent-contact mechanism:

In this case, the seat plate 16 is rotatably mounted on the backrest carrier 18 behind the axle shaft 19 by means of a further axle shaft 31. The bores necessary for this and the force-transmitting connection part are preferably obtained in an especially simple way by means of formed-on ribbed seat bearings 21. This is possible when the seat plate 16 is a molding, that is to say, for example, is injection-molded from plastic. If the axle shaft 31 is secured axially in the longitudinal direction in the customary way, for example by means of two retaining washers, the rearwardly tiltable seat is fastened immovably in the longitudinal and transverse directions. Moreover, as can be seen from FIG. 1, the ribbed seat bearings 21 can also be present in the permanent-contact mechanism, but in this case inoperative, for the sake of simplified production.

The tilt ratio of the seat plate 16 or seat in relation to the backrest is determined by the position of the rear and front bearing points of the seat plate 16 in relation to the position of the axle shaft 19. To keep the "leg-lifting effect" as low as possible, the front bearing point of the seat plate 16 will be located as near as possible to the front edge of the seat.

As already mentioned previously in the description of the permanent-contact backrest, the seat plate 16 is supported in the front region on the crossmember 3 on the right and left by means of the formed-on supporting projections 22. The supporting projections 22, by virtue of their rounded shape, allow some unimpeded tilt variation. Lateral displacement is preferably prevented by a respective lateral retaining rib 23 which is formed externally on the seat plate 16 on the left and right near the end of the crossmember 3. Hooks which come from the seat plate 16 from above and engage round the crossmember 3 on the right and left and which have formed-on counter-projections 24 retain the seat plate 16 in the upward direction. The hooks are preferably likewise formed on the seat plate 16.

Thus, the seat plate 16 is retained on all sides, but remains longitudinally displaceable, so that the relative travel occurring at the rear fastening can be compensated. The mutually opposite projections 22 and 24 guarantee that the tilt of the seat can vary to a sufficient extent. As shown in FIG. 1, for the sake of simplified production, this fastening system can likewise also be used for the permanent-contact mechanism.

The described fastenings of the rear and front are an integral part of a single seat plate 16 which can be used unchanged for both mechanism versions. The seat cover 17 with the slotted guide **15*b* and with the locking pin 7 guided in this can likewise be adopted unchanged: although, the seat changes its tilt and position in relation to the locking pin 7 mounted in the crossmember 3, nevertheless the width distance between the backrest carrier 18 and the cranked end of the locking pin 7** does not change. This fact guarantees that the selected construction will function reliably. The slight changes in position in the longitudinal direction which occur during a tilting of the seat are insignificant in this respect.

Higher-quality simultaneous compensating springs **25*a*, *b* are provided (FIG. 3) as spring elements in the synchronous mechanism instead of the simpler permanent compensating springs 20. These inevitably afford a substantially higher working capacity than the permanent compensating springs 20. In particular, they have to compensate the leaning moment and the greatest part of the sitting weight of the user. The simultaneous compensating springs 25*a*, *b* can be accommodated in a space-saving and inconspicuous manner approximately horizontally under the seat next to the mechanism and next to the backrest carrier 18 in a way known per se. This arrangement is advantageous, since, in this case, one of the two ends of the springs can be fastened respectively to the crossmember 3**.

The predominantly vertically effective change in travel of the backrest carrier 18 is transmitted to the springs by means of pull cables 27 which are deflected by deflecting rollers 28 or, to save constructional height, deflecting segments **28*a* mounted on an angle lever 26**.

So that the synchronous mechanism can be adjusted to the user's individual body weight, it is sufficient to make one of the two simultaneous compensating springs (**25*b*) variable in length and therefore in spring force. This can be carried out, for example, via a rotation-proof threaded rod 29 with a formed-on suspension lug for the spring. A hollow rotary knob 30** with a thread, which is supported on the crossmember and which receives in it the free end of the threaded rod, makes the desired individual adjustment possible.

In the simultaneous mechanism, where the previously described longitudinally movable fastening of the seat at the front is concerned, the friction between the supporting projection 22 and the crossmember 3 located under it always has to be overcome. To reduce these frictional forces, the supporting projections 22 can advantageously also be replaced by a roller 33 which is snapped into ribs 32 formed on the seat plate and which is mounted therein (FIG. **2*b*). Another possibility provides coupling members (for example, made of plastic) which are respectively fastened rotatably to the seat plate 16** and to a bracket on the right and left.

We claim:

1. A tilt device for seat furniture, comprising:

(a) a base which can be fastened to an underframe of the seat furniture and which serves as a carrier for a seat and a backrest;

(b) an angular backrest carrier with a lower leg and an upper leg, said backrest carrier being rotatably mounted on the base in a middle region of its lower leg by means of a rotary bearing and consisting, at least in its lower leg, of two backrest cheeks arranged parallel to and at a distance from one another;

(c) a seat plate which is supported at least in its front region by the base; and (d) at least one spring element having one end which is fastened to the base and another end which engages the backrest carrier behind the rotary bearing and exerts an upwardly directed force on the backrest carrier;

wherein:

(e) the base is designed as a narrow closed carrier box which is composed of a plurality of sheet-metal parts and which is arranged between the backrest cheeks; and (f) the carrier box has on its front side a sheet-metal crossmember which projects laterally beyond the backrest cheeks and which carries the seat plate in its front region;

the tilt device further comprising:

(g) a locking device having a locking pin which can engage into a plurality of locking bores located at the front of the backrest carrier, the locking bores being made directly on the front end of one of the backrest cheeks, and the crossmember having on the side which projects beyond the backrest cheek equipped with the locking bores, two mutually spaced tabs which are perpendicular to the crossmember and in which the locking pin is guided.

2. The tilt device as claimed in claim 1, wherein (a) the sheet-metal parts of the carrier box and the crossmember are deep-drawn sheet-metal parts or bent parts;

(b) the carrier box comprises a box-shaped lower part and a cover; and (c) the cover, the lower part and the crossmember are connected to one another by means of a plurality of welding spots.

3. The tilt device as claimed in claim 1, wherein (a) the tabs are designed as sheet-metal parts bent out from the crossmember; and (b) on one of the tabs there is a tolerance-compensating bearing, in which the locking pin is guided with lateral play.

4. The tilt device as claimed in claim 1, further comprising means for mounting the seat plate in its front region on the crossmember in a horizontally displaceable manner.

5. The tilt device as claimed in claim 4, wherein (a) the seat plate is rigidly connected in its rear region to the carrier box; and (b) the at least one spring element comprises a permanent compensating spring having one end which is fastened on to the rear end of the carrier box.

6. The tilt device as claimed in claim 5, wherein (a) a rear region of the seat plate is rotatably mounted on the backrest carrier; and (b) the at least one spring element comprises a plurality of simultaneous compensating springs which are arranged parallel to the carrier box and which have one end fastened to the crossmember and another end which engages on the backrest carrier via a deflected pull cable.

7. The tilt device as claimed in one of claims 4–6, wherein, for mounting the seat plate on the carrier box, (a) ribbed seat bearings are provided in the rear region of the seat plate;

(b) in the front region of the seat plate, part of the crossmember is guided horizontally between supporting projections or a roller running in ribs and counter-projections; and (c) the ribbed seat bearings, supporting projections and counter-projections are designed as parts formed on the seat plate.

8. The tilt device as claimed in claim 1, wherein (a) the rotary bearing for the backrest carrier comprises an axle shaft which is pressed into the carrier box; and (b) for fastening the carrier box to the underframe of the seat furniture there is a receiving cone which is pressed into the carrier box.

9. The tilt device as claimed in claim 1, wherein (a) the locking pin of the locking device is cranked perpendicularly to the pin axis at its end facing away from the locking bores; and (b) the cranked end is guided, by means of a stepped sleeve attached resiliently onto it, in a recess which has the form of a thread segment and which is designed as a slotted guide.

* * * * *